US012680386B2

(12) United States Patent
Keskiniva

(10) Patent No.: US 12,680,386 B2
(45) Date of Patent: Jul. 14, 2026

(54) HYBRID HYDRAULIC DOWN-THE-HOLE HAMMER

(71) Applicant: Mincon International Limited, Shannon (IE)

(72) Inventor: Markku Keskiniva, Ylinen (FI)

(73) Assignee: MINCON INTERNATIONAL LIMITED, Shannon (IE)

( * ) Notice: Subject to any disclaimer, the term of this patent is extended or adjusted under 35 U.S.C. 154(b) by 0 days.

(21) Appl. No.: 18/996,657

(22) PCT Filed: Jul. 20, 2023

(86) PCT No.: PCT/EP2023/070185
§ 371 (c)(1),
(2) Date: Jan. 17, 2025

(87) PCT Pub. No.: WO2024/018015
PCT Pub. Date: Jan. 25, 2024

(65) Prior Publication Data

US 2026/0035997 A1 Feb. 5, 2026

(30) Foreign Application Priority Data

Jul. 21, 2022 (IE) ..... 2022/0123
Nov. 4, 2022 (IE) ..... 2022/0177

(51) Int. Cl.
*E21B 4/14* (2006.01)

(52) U.S. Cl.
CPC ..... *E21B 4/14* (2013.01)

(58) Field of Classification Search
CPC ..... E21B 4/14
See application file for complete search history.

(56) References Cited

U.S. PATENT DOCUMENTS 5,396,965 A * 3/1995 Hall ..... E21B 4/14 173/78
6,047,778 A 4/2000 Coffman et al.
(Continued)

FOREIGN PATENT DOCUMENTS

WO WO-2021/159620 A1 8/2021

OTHER PUBLICATIONS

International Search Report and Written Opinion issued in related International Application No. PCT/EP2023/070185 datred Oct. 12, 2023.

*Primary Examiner* — Taras P Bemko
(74) *Attorney, Agent, or Firm* — RENNER, OTTO, BOISSELLE & SKLAR, LLP

(57) ABSTRACT

The present invention relates to a closed-loop hydraulic down-the-hole hammer. The hammer comprises an elongate shaft and a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore. The hammer also comprises a control valve to control reciprocation of the piston, wherein the control valve is arranged within the central bore of the piston. The hammer further comprises an outer wear sleeve, wherein the piston is housed within the outer wear sleeve. A supplementary rear drive chamber is disposed internally of the outer wear sleeve. According to another aspect of the invention, the hammer comprises a control valve housing, disposed at least partially within the central bore of the shaft at a forward end of the shaft and arranged to receive the control valve, the control valve housing having a tapered outer surface at a forward portion thereof and an annular flange connected to the shaft and
(Continued)

having a tapered inner surface, corresponding in shape to and engageable with the tapered outer surface of the control valve housing, whereby the control valve housing is retained in the shaft by the annular flange. The hammer further comprises engagement means on the control valve housing slidably engageable with complementary engagement means on the shaft to prevent relative rotation therebetween.

19 Claims, 7 Drawing Sheets

(56) References Cited

U.S. PATENT DOCUMENTS

| | | | | |
|---|---|---|---|---|
| 6,386,301 | B1 * | 5/2002 | Rear | E21B 4/14 175/321 |
| 9,016,403 | B2 * | 4/2015 | Aros | E21B 4/14 175/296 |
| 9,776,314 | B1 | 10/2017 | Swinford | |
| 2005/0252671 | A1 * | 11/2005 | Gien | E21B 4/14 173/91 |
| 2009/0071725 | A1 | 3/2009 | Purcell | |
| 2017/0152711 | A1 * | 6/2017 | Boswell | E21B 4/14 |
| 2018/0044991 | A1 * | 2/2018 | Speer | E21B 21/082 |
| 2022/0349256 | A1 * | 11/2022 | Purcell | E02D 7/28 |

* cited by examiner

--PRIOR ART--

--PRIOR ART--

HYBRID HYDRAULIC DOWN-THE-HOLE HAMMER

FIELD OF THE INVENTION

The present invention relates to hydraulic percussion drill tools, and in particular to hydraulic down-the-hole hammers.

BACKGROUND TO THE INVENTION

Hydraulically powered down-the-hole hammers generally include three principal components—an impact piston to impart percussion energy to a drill bit or tool located at a forward end of the hammer; a shuttle or control valve to control the flow of hydraulic fluid in the hammer, to apply pressure to faces of the impact piston, thereby creating cyclical forces that cause reciprocal motion of the piston; and one or more accumulators to take in, store and deliver back pressurised hydraulic fluid to accommodate the varying instantaneous flow requirements created by the reciprocation of the piston.

Certain hydraulic down-the-hole hammers, such as those in which water is the working fluid, are referred to as flow-through hammers. A conventional water-powered hammer 100 of this type is shown in FIG. 1. The piston 101 reciprocates within an outer cylinder to impact a bit 109 at a forward end of the hammer. The piston drive chambers 102, 103 are arranged between the piston and an outer cylinder 104, and the control valve 105 and accumulators 106 are positioned at a rear end 107 of the piston. Working fluid is provided to the hammer via pressure line P and is also used for flushing flow 108, which flushes cuttings from the hole as it is drilled. The piston is fully submerged in water and only a small portion of the cross-section area of the piston is used to drive the piston. The rest of the cross-sectional area is idling, as it is exposed to ambient pressure. This means that the non-driving area of the piston needs to displace a large amount of water during operation of the hammer. This is achieved by having a central bore 110 through the piston so that the forward 111 and rear 107 ends of the piston are in fluid communication with each other.

Other hydraulic down-the-hole hammers have a closed-loop arrangement. A conventional closed-loop hydraulic down-the-hole hammer 200 is shown in FIG. 2.

The set-up is similar to that outlined above and shown in FIG. 1. However, in a closed-loop hammer, working fluid, such as oil, is provided to the hammer via pressure line P and returned via return line T. In the hammer shown in FIG. 2, the piston is solid and a separate flow of flushing fluid 208, such as air, is provided to flush cuttings from the hole. A disadvantage of this arrangement is that much of the energy used to deliver the flushing fluid is lost, as the flushing flow typically has more energy than is required to flush cutting from the hole.

It would be desirable to provide a hydraulic down-the-hole hammer that addresses some of the disadvantages associated with existing arrangements.

Hydraulic down-the-hole hammers have also been proposed where the control valve is arranged within a central bore of a shaft upon which the piston is mounted. In such arrangements, it is necessary to have an opening at one end of the shaft, in order to allow the valve to be inserted into the central bore of the shaft. It is desirable to provide an arrangement to close the opening through which the valve is inserted and to create a hydraulic pressure area for the valve.

SUMMARY OF THE INVENTION

According to an aspect of the present invention, there is provided a closed-loop hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore;

a control valve to control reciprocation of the piston, wherein the control valve is arranged within the central bore of the piston; and an outer wear sleeve, wherein the piston is housed within the outer wear sleeve, and wherein a supplementary rear drive chamber is disposed internally of the outer wear sleeve.

The supplementary rear drive chamber may be at least partially disposed between the shaft and the outer wear sleeve. The supplementary rear drive chamber may be at least partially disposed between the piston and the outer wear sleeve. In certain embodiments, a first portion of the supplementary rear drive chamber may be disposed between the shaft and the outer wear sleeve and a second portion of the supplementary rear drive chamber may be disposed between the piston and the outer wear sleeve.

The percussion bit may be arranged at a forward end of the hammer. For example, the percussion bit may be arranged at a forward end of the outer wear sleeve, or may be connected to the shaft.

Preferably, the supplementary rear drive chamber is arranged to receive a separate flow of fluid to that supplied to the forward and rear drive chambers. The supplementary rear drive chamber may be arranged to receive flushing fluid. The flushing fluid may be air. The forward and rear drive chambers may be arranged to receive a working fluid, such as hydraulic oil or water.

An advantage of this arrangement is that energy in the separate fluid flow, such as flushing fluid, is used to help drive the piston, so that the hammer operates a hybrid cycle in which the piston is driven both by hydraulic or working fluid and also by flushing fluid. Thus, the flushing fluid may provide a secondary means of piston propulsion. Efficiency is increased as compared with typical closed-loop hydraulic hammers since energy from flushing air, which would otherwise be lost, may be used to help drive the piston.

When the piston moves in a rearward direction, an outer surface of the piston may move into engagement with an inner surface of the outer wear sleeve to close the supplementary rear drive chamber, and the supplementary drive chamber may be connected to a supply of pressurised flushing fluid. The supplementary drive chamber may be connected to the supply of pressurised flushing fluid after the outer surface of the piston moves into engagement with the inner surface of the outer wear sleeve. Engagement between the outer surface of the piston and an inner surface of the outer wear sleeve may close the supplementary rear drive chamber at a forward end thereof.

For example, the supplementary rear drive chamber may be closed or sealed by engagement between the outer surface of the piston and an inwardly directed shoulder formed internally of the outer wear sleeve. In an embodiment, the supplementary rear drive chamber may be closed or sealed by engagement between an outwardly directed shoulder formed externally of the piston and an inwardly directed shoulder formed internally of the piston. In another embodiment, the supplementary rear drive chamber may be closed or sealed by engagement between a rear end of the piston and an inwardly directed shoulder formed internally of the piston. Rearward movement of the piston may be controlled by the working fluid cycle only.

When the piston moves in a forward direction, the outer surface of the piston may move out of engagement with the inner surface of the outer wear sleeve to open the supplementary rear drive chamber, to provide a flushing fluid channel between the piston and the outer wear sleeve, to allow flushing fluid to flow therebetween. Flushing fluid may then flow through the percussion bit to the bit face. Forward movement of the piston may be controlled by the both the working fluid cycle and the pressurised flushing fluid in the supplementary rear drive chamber. Prior to the outer surface of the piston moving out of engagement with the inner surface of the outer wear sleeve, the supplementary rear drive chamber may be disconnected from the supply of pressurised flushing fluid.

According to an aspect of the present invention, there is provided a closed-loop hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore;

a control valve to control reciprocation of the piston, wherein the control valve is arranged within the central bore of the piston; and an outer wear sleeve, wherein the piston is housed within the outer wear sleeve, and wherein a supplementary rear drive chamber or pneumatic rear chamber is disposed between the piston and the outer wear sleeve.

The term "forward" is used herein to indicate an end of the hammer towards the percussion bit, that is, the drilling end of the hammer. The term "rear" is used herein to indicate an end of the hammer, away from the percussion bit, that is, an end of the hammer that is uppermost during drilling.

The percussion bit may be arranged at a forward end of the hammer. For example, the percussion bit may be arranged at a forward end of the outer wear sleeve, or may be connected to the shaft.

Preferably, the supplementary rear drive chamber is arranged to receive a separate flow of fluid to that supplied to the forward and rear drive chambers. The supplementary rear drive chamber may be arranged to receive flushing fluid. The flushing fluid may be air. The forward and rear drive chambers may be arranged to receive a working fluid, such as hydraulic oil or water.

An advantage of this arrangement is that energy in the separate fluid flow, such as flushing fluid, is used to help drive the piston, so that the hammer operates a hybrid cycle in which the piston is driven both by hydraulic or working fluid and also by flushing fluid. Thus, the flushing fluid may provide a secondary means of piston propulsion. Efficiency is increased as compared with typical closed-loop hydraulic hammers since energy from flushing air, which would otherwise be lost, may be used to help drive the piston.

When the piston moves in a rearward direction, an outer surface of the piston may move into engagement with an inner surface of the outer wear sleeve to close or seal the supplementary drive chamber, and the supplementary drive chamber may be connected to a supply of pressurised flushing fluid. The supplementary drive chamber may be connected to the supply of pressurised flushing fluid after the outer surface of the piston moves into engagement with the inner surface of the outer wear sleeve. Engagement between the outer surface of the piston and an inner surface of the outer wear sleeve may close the supplementary rear drive chamber at a forward end thereof. For example, the supplementary rear drive chamber may be closed or sealed by engagement between an outwardly directed shoulder formed externally of the piston and an inwardly directed shoulder formed internally of the piston. Rearward movement of the piston may be controlled by the working fluid cycle only.

When the piston moves in a forward direction, the outer surface of the piston may move out of engagement with the inner surface of the outer wear sleeve to open the supplementary rear drive chamber, to provide a flushing fluid channel between the piston and the outer wear sleeve, to allow flushing fluid to flow therebetween. Flushing fluid may then flow through the percussion bit to the bit face. Forward movement of the piston may be controlled by the both the working fluid cycle and the pressurised flushing fluid in the supplementary rear drive chamber. Prior to the outer surface of the piston moving out of engagement with the inner surface of the outer wear sleeve, the supplementary rear drive chamber may be disconnected from the supply of pressurised flushing fluid.

According to another aspect of the present invention, there is provided a hydraulic down-the-hole hammer comprising:

an elongate shaft having a central bore;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore;

a control valve to control reciprocation of the piston;

a control valve housing, disposed at least partially within the central bore of the shaft at a forward end of the shaft and arranged to receive the control valve, the control valve housing having a tapered outer surface at a forward portion thereof;

an annular flange or bushing connected to the shaft and having a tapered inner surface, corresponding in shape to and engageable with the tapered outer surface of the control valve housing, whereby the control valve housing is retained in the shaft by the annular flange; and engagement means on the control valve housing slidably engageable with complementary engagement means on the shaft to prevent relative rotation therebetween.

This aspect of the invention may be particularly advantageous where the hammer is a closed-loop hydraulic down-the-hole hammer, but may also be applied to open-loop hammers.

An advantage of this arrangement is that the annular flange retains the control valve housing, and thus the control valve, in the hammer. Together, the tapered outer surface of the control valve housing and the tapered inner surface of the annular flange may form a taper lock which prevents disconnection of the annular flange from the shaft during operation of the hammer. That is, engagement between the tapered outer surface and the tapered inner surface prevents the annular flange from becoming disconnected from the shaft during operation of the hammer. The engagement means also prevents relative rotation between the control valve housing and the shaft, thereby preventing the annular flange from becoming disconnected from the shaft during operation of the hammer.

The tapered outer surface may be arranged to be urged or forced into engagement with the tapered inner surface by a flow of pressure fluid through the control valve. An advantage of this arrangement is that during operation of the hammer, the control valve housing is firmly seated within the taper lock by the constant supply of high pressure working fluid to the hammer.

The tapered outer surface may be provided at a portion of the control valve housing forward of a forward end of the shaft. A rear portion of the control valve housing may be disposed within the central bore of the shaft.

The hammer may further comprise connection means on the annular flange adapted for connecting the flange to the shaft. The connection means on the annular flange may comprise a screw-thread provided at a rear end thereof, and a corresponding screw-thread may be provided on the shaft at a forward end thereof. In one embodiment, the screw-thread is provided internally of the annular flange and the corresponding screw-thread is provided externally of the chuck. Alternatively, the screw-thread may be provided externally of the annular flange and the corresponding screw-thread may be provided internally of the chuck.

The engagement means may be provided on an outer surface of the control valve housing and the complementary engagement means may be provided on an inner surface of the shaft. The engagement means may comprise a key provided on the outer surface of the control valve housing. The key may be received in a slot in the outer surface of the control valve housing. The complementary engagement means may comprise a groove provided on the inner surface of the shaft. In other embodiments, the engagement means may comprise one or more splines provided on the outer surface of the control valve housing and the complementary engagement means may comprise a corresponding spline or splines provided on an inner surface of the shaft. Alternatively, the engagement means may comprise a shaped outer profile portion of the control valve housing, for example, a square, hexagonal or octagonal profile section. The complementary engagement means may comprise a correspondingly-shaped inner profile section of the shaft. The engagement means may be provided at a portion of the control valve housing rearward of the tapered outer surface.

The tapered outer surface portion of the control valve housing may be substantially frustro-conical in shape. A taper angle of the tapered outer surface portion may be between about 1 degree and about 5 degrees. A taper angle of the tapered inner surface of the annular flange may be substantially the same as the taper angle of the tapered outer surface of the control valve housing.

The hammer may further comprise a removable locking fastener arranged to pre-lock the tapered outer surface into engagement with the tapered inner surface, prior to operation of the hammer. The fastener may be a bolt, or similar assembly tool. The fastener may be engageable with the flange and the control valve housing to pre-lock the tapered outer surface into engagement with the tapered inner surface. The fastener may be removed prior to operation of the hammer.

DETAILED DESCRIPTION OF THE DRAWINGS

Figure 1:
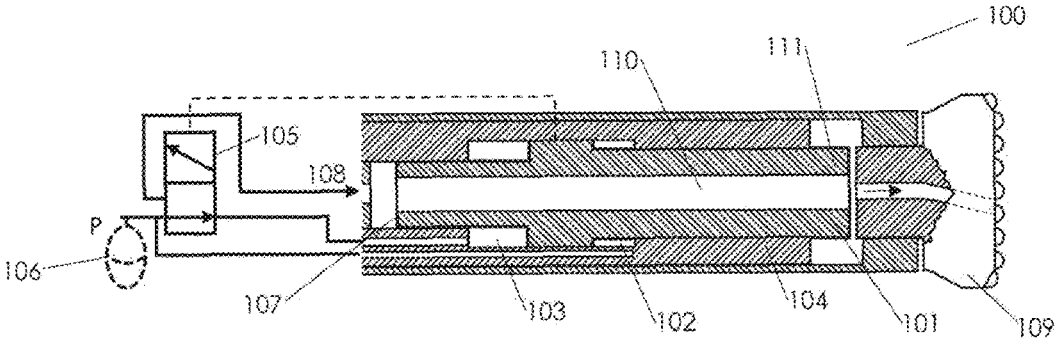
FIG. 1 is a schematic representation of a conventional flow-through hydraulic down-the-hole hammer.
Figure 2:
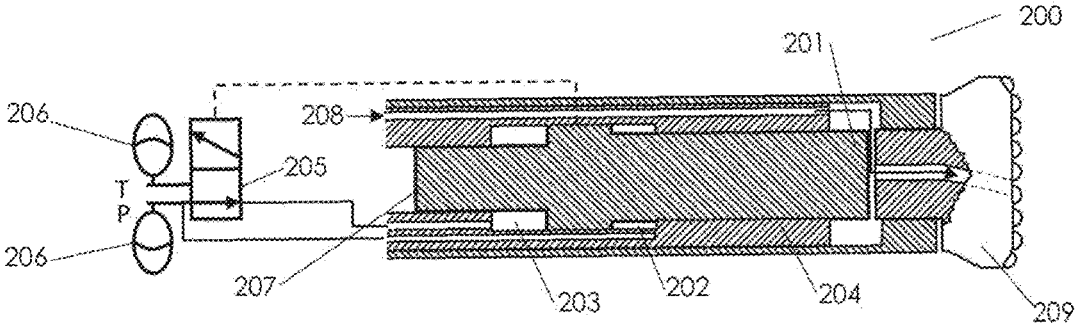
FIG. 2 is a schematic representation of a conventional closed-loop hydraulic down-the-hole hammer.
Figure 3:
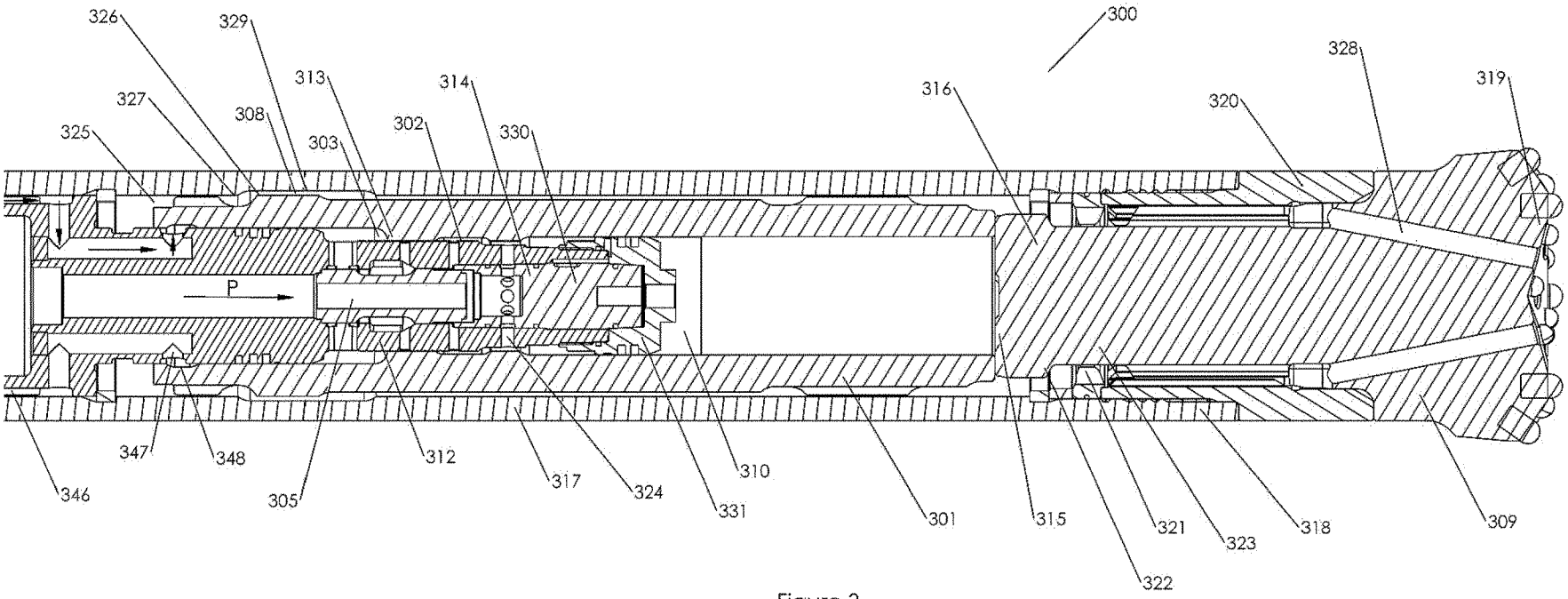
FIG. 3 is a cross-sectional view of a forward end of a closed-loop hydraulic down-the-hole hammer according to an embodiment of the present invention, in which the piston is in a bottom of stroke position.
Figure 4:
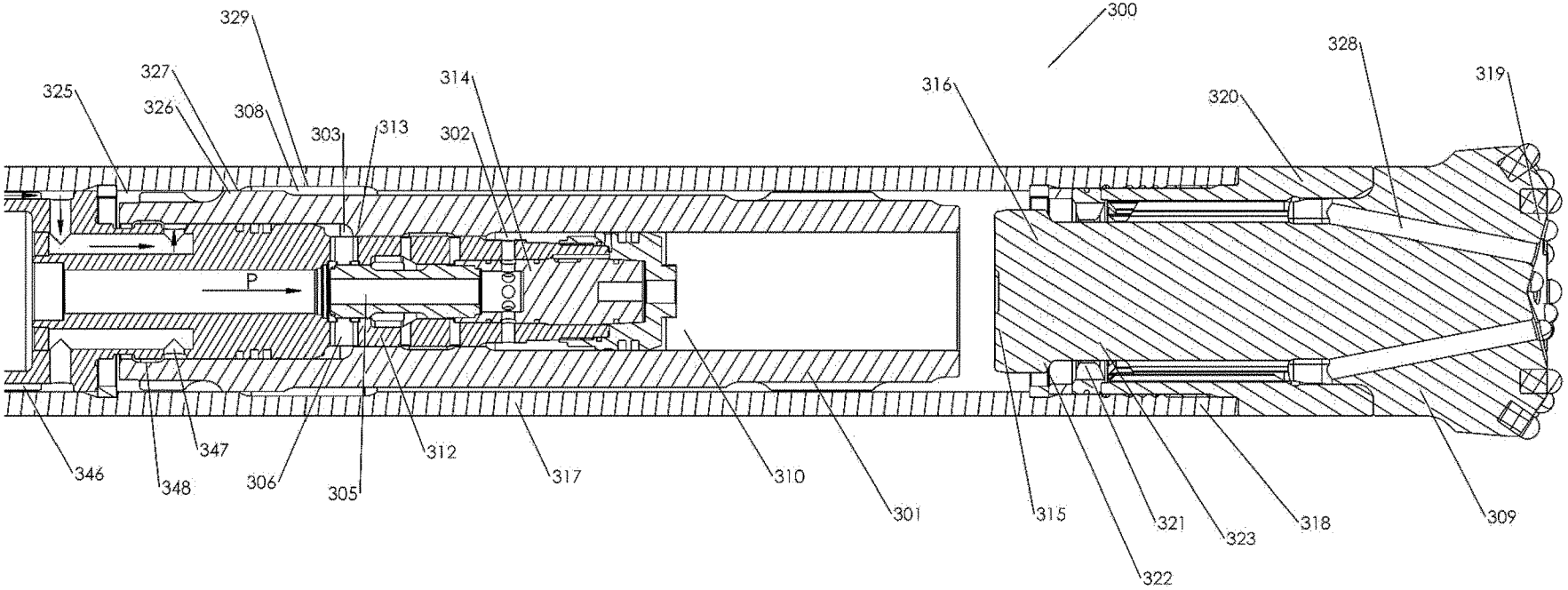
FIG. 4 is a cross-sectional view of the forward end of the closed-loop hydraulic down-the-hole hammer of FIG. 3, in which the piston is in a top of stroke position.

A forward end of a closed-loop hydraulic down-the-hole hammer 300 according to an embodiment of the present invention is illustrated in FIGS. 3 and 4. The hammer comprises an elongate shaft 312 formed with a central bore 314. A piston 301 also has a central bore 310 therethrough. The shaft is received within the piston bore such that the piston is slidably mounted for reciprocal movement on the shaft 312 and arranged to impact a strike face 315 at a rear end 316 of a percussion bit 309. The piston 301 is housed within an outer wear sleeve 317 and the percussion bit is arranged at a forward end 318 of the outer wear sleeve.

In the embodiment shown, a chuck 320 is provided between the forward end of the wear sleeve and the percussion bit to transfer rotational drive to the bit. As shown in FIG. 3, the chuck is screw-threadably connected to the forward end of the wear sleeve and rotational drive is transferred by way of a splined engagement between the chuck and a shank 323 of the percussion bit. A bit retaining ring 321 is provided between the outer wear sleeve and the chuck to retain the percussion bit in the hammer by engagement with a bit retaining shoulder 322 on the bit shaft. In alternative embodiments, other arrangements for rotational drive and bit retention may be used. For example, the percussion bit may be formed with an octagonal or hexagonal shank and the chuck may be formed with a corresponding double-octagonal or double-hexagonal internal profile, such that the shank is engageable with one of the profiles of the chuck. In other embodiments, rotational drive may be transmitted to the bit via a coupling arrangement with the shaft 312. Bit retaining means may also be provided on the shaft for longitudinal coupling of the bit to the hammer.

Forward 302 and rear 303 drive chambers for the piston are disposed between the piston 301 and the shaft 312. An annular shoulder 313 on the piston formed internally of the piston bore 310 separates the forward chamber 302 from the rear chamber 303. An internal diameter of the piston 301 to the rear of the shoulder 313 is larger than the internal diameter of the piston forward of the shoulder, such that the rear chamber has a larger driving area than the forward chamber. The hammer also comprises a control valve 305 arranged within the central bore 314 of the shaft to control reciprocation of the piston. In other embodiments, the valve 305 may be arranged within the central bore 310 of the piston, between the piston and the shaft. A supplementary rear drive chamber 325 is disposed internally of the outer wear sleeve. In the embodiment shown in FIGS. 3 and 4, the supplementary rear drive chamber is partially disposed between the piston and the outer wear sleeve. The supplementary rear drive chamber is also partially disposed between the shaft 312 and the outer wear sleeve. That is, a first portion of the supplementary rear drive chamber is disposed between the shaft and the outer wear sleeve and a second portion of the supplementary rear drive chamber is disposed between the piston and the outer wear sleeve.

Working fluid is provided to the hammer via pressure line P and returned via a return line. The forward chamber 302 is connected to the pressure fluid channel P throughout the hammer cycle so that there is a constant pressure in the forward chamber. In FIG. 3, the piston is in a bottom of stroke position, in which it is in contact with the strike face 315 of the bit. Because the forward chamber 302 is connected to high pressure working fluid through port 324 in the shaft, as shown by the arrows in FIG. 3, and the rear chamber is connected to the return line, the piston moves in a rearward direction, that is, the piston lifts from the bottom of stroke position due to the pressurised working fluid in the forward chamber 302.

The supplementary rear drive chamber 325 is arranged to receive a separate flow of fluid to the working fluid supplied to the forward and rear drive chambers. In the embodiment shown, the supplementary rear drive chamber is arranged to receive a flow of flushing fluid, such as air. In this case, the supplementary drive chamber may also be referred to as a pneumatic rear chamber.

FIG. 3 shows the piston 301 in the strike position, in which the piston impacts the strike face 315 of the bit 309. In this position, the supplementary rear drive chamber 325 is open to flush through a flushing fluid channel 308 provided between the piston 301 and the wear sleeve 317. In the embodiment shown, an undercut 329 is provided internally of the outer wear sleeve to allow flushing fluid to flow between the piston and the wear sleeve. A scallop is also provided in the bit retaining ring 321 to allow flushing fluid to flow from the flushing fluid channel 308, between the chuck 320 and the bit shank 323 and through the flushing channels 328 in the percussion bit 309, so that the flushing fluid exits the channel at the bit face 319.

The piston 301 then moves in a rearward direction, under control of the working fluid as set out above. As the piston moves rearwards, an outwardly directed shoulder 326 formed externally of the piston is brought into engagement with an inwardly directed shoulder 327 formed internally of the outer wear sleeve. This serves to close or seal the supplementary rear drive chamber 325 at a forward end thereof, preventing flushing fluid from entering the flushing fluid channel 308 and exhausting through the bit 309. This begins a compression phase in the supplementary rear drive chamber.

When the piston reaches the position shown in FIG. 4, pressurised flushing fluid is supplied to the supplementary rear drive chamber 325 from high pressure line 346 via port 347 in the shaft and undercut 348 in the piston. Because of the engagement between the shoulder 326 on the piston and the shoulder 327 on the wear sleeve, flushing fluid supplied to the hammer accumulates in the supplementary rear drive chamber so that this chamber becomes pressurised. The rear chamber 303 formed internally of the piston is also pressurised by working fluid supplied to it via port 306. The rear chamber 303 has a bigger pressure area than the forward chamber 302, due to the increased internal diameter of the piston 301. Thus, both the flushing fluid and working fluid act on the piston 301 to reverse the piston and drive it forward.

As the piston moves in the forward direction, port 347 in the shaft is closed by the piston so that the supplementary rear drive chamber is disconnected from the supply of pressurised flushing fluid, thereby beginning an expansion phase in the supplementary rear drive chamber. Next, the shoulder 326 on the piston clears the shoulder 327 on the outer wear sleeve so that the supplementary rear drive chamber is opened once again to allow flushing fluid to flow through the flushing fluid channel 308 between the outer wear sleeve and the piston, so that it exhausts through the bit and into the hole. When the piston 301 reaches the impact or bottom of stroke position, the cycle begins again.

Figure 8:
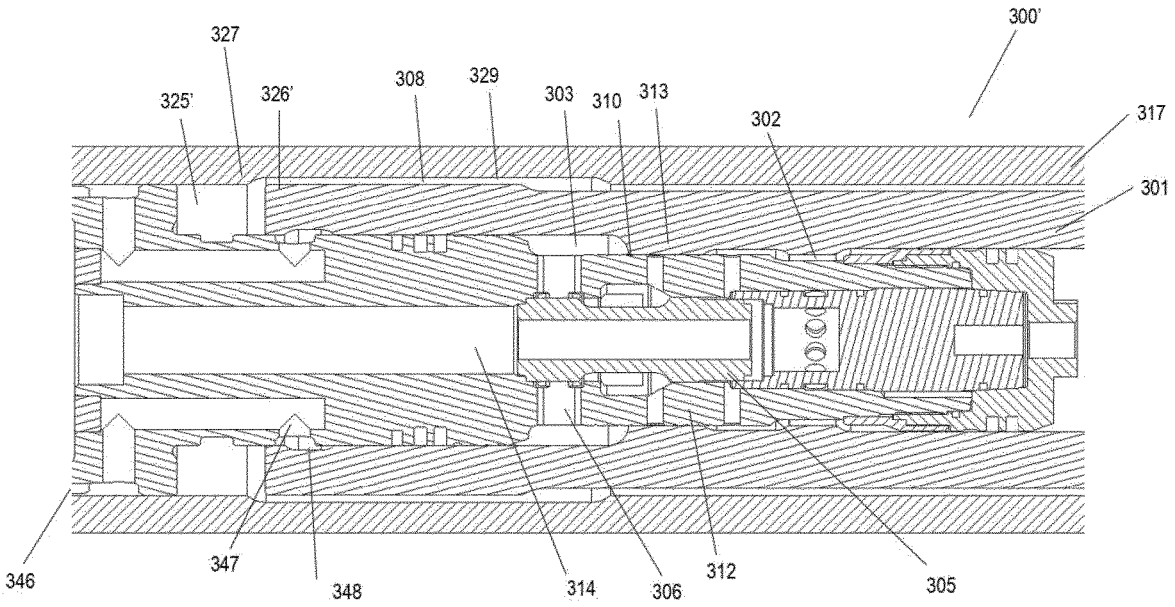
FIG. 8 is a cross-sectional view of a portion of a closed-loop hydraulic down-the-hole hammer according to an embodiment of the present invention, in which the piston is in a bottom of stroke position.
Figure 9:
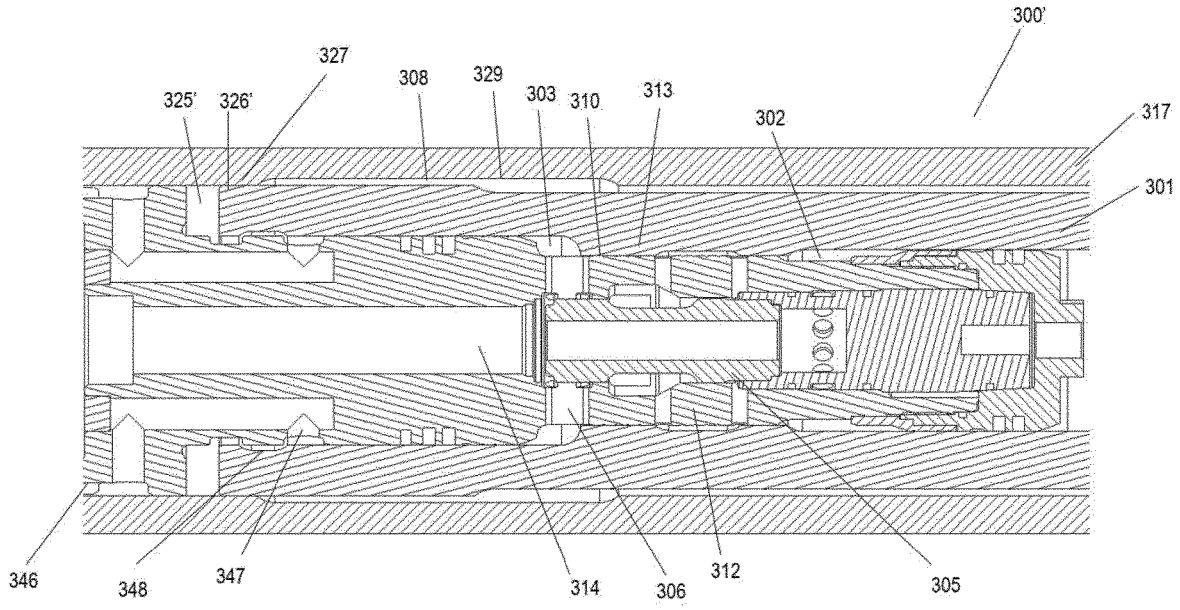
FIG. 9 is a cross-sectional view of the portion of the closed-loop hydraulic down-the-hole hammer o FIG. 8, in which the piston is in a top of stroke position.

Another embodiment of a closed-loop hydraulic down-the-hole hammer 300' according to the invention is illustrated in FIGS. 8 and 9. As in the embodiment shown in FIGS. 3 and 4, the hammer comprises an elongate shaft 312 formed with a central bore 314. A piston 301 also has a central bore 310 therethrough. The shaft is received within the piston bore such that the piston is slidably mounted for reciprocal movement on the shaft 312 and arranged to impact a strike face at a rear end of a percussion bit, as in the embodiment shown in FIGS. 3 and 4. The piston 301 is housed within an outer wear sleeve 317 and the percussion bit is arranged at a forward end of the outer wear sleeve.

Although not shown in FIGS. 8 and 9, similar arrangements to those shown and described in relation to FIGS. 3 and 4 may be provided for transfer of rotational drive to the bit and retention of the bit in the hammer.

Forward 302 and rear 303 drive chambers for the piston are disposed between the piston 301 and the shaft 312. An annular shoulder 313 on the piston formed internally of the piston bore 310 separates the forward chamber 302 from the rear chamber 303. An internal diameter of the piston 301 to the rear of the shoulder 313 is larger than the internal diameter of the piston forward of the shoulder, such that the rear chamber has a larger driving area than the forward chamber. The hammer also comprises a control valve 305 arranged within the central bore 314 of the shaft to control reciprocation of the piston. In other embodiments, the valve 305 may be arranged within the central bore 310 of the piston, between the piston and the shaft. A supplementary rear drive chamber 325' is disposed internally of the outer wear sleeve. In the embodiment shown in FIGS. 8 and 9, the supplementary rear drive chamber 325' is disposed between the shaft and the outer wear sleeve.

Working fluid is provided to the hammer via pressure line P and returned via a return line. The forward chamber 302 is connected to the pressure fluid channel P throughout the hammer cycle so that there is a constant pressure in the forward chamber. In FIG. 8, the piston is in a bottom of stroke position, in which it is in contact with the strike face of the bit. Because the forward chamber 302 is connected to high pressure working fluid through a port in the shaft, in a similar manner to that shown in FIG. 3, and the rear chamber is connected to the return line, the piston moves in a rearward direction, that is, the piston lifts from the bottom of stroke position due to the pressurised working fluid in the forward chamber 302.

The supplementary rear drive chamber 325' is arranged to receive a separate flow of fluid to the working fluid supplied to the forward and rear drive chambers. In the embodiment shown in FIGS. 8 and 9, the supplementary rear drive chamber is arranged to receive a flow of flushing fluid, such as air. In this case, the supplementary drive chamber may also be referred to as a pneumatic rear chamber.

FIG. 8 shows the piston 301 in the strike position, in which the piston impacts the strike face of the bit. In this position, the supplementary rear drive chamber 325' is open to flush through a flushing fluid channel 308 provided between the piston 301 and the wear sleeve 317. In the embodiment shown, an undercut 329 is provided internally of the outer wear sleeve to allow flushing fluid to flow between the piston and the wear sleeve. Similar arrangements to those shown in FIGS. 3 and 4 may be provided in order to allow the flushing fluid to flow through the hammer to the bit face.

The piston 301 then moves in a rearward direction, under control of the working fluid as set out above. As the piston moves rearwards, an outer surface of the rear end 326' of the piston is brought into engagement with an inwardly directed shoulder 327 formed internally of the outer wear sleeve. This serves to close or seal the supplementary rear drive chamber 325' at a forward end thereof, preventing flushing fluid from entering the flushing fluid channel 308 and exhausting through the bit. This begins a compression phase in the supplementary rear drive chamber.

When the piston reaches the position shown in FIG. 9, pressurised flushing fluid is supplied to the supplementary rear drive chamber 325 from high pressure line 346 via port 347 in the shaft and undercut 348 in the piston. Because of the engagement between the rear end 326' of the piston and the shoulder 327 on the wear sleeve, flushing fluid supplied to the hammer accumulates in the supplementary rear drive chamber so that this chamber becomes pressurised. The rear chamber 303 formed internally of the piston is also pressurised by working fluid supplied to it via port 306. The rear chamber 303 has a bigger pressure area than the forward chamber 302, due to the increased internal diameter of the piston 301. Thus, both the flushing fluid and working fluid act on the piston 301 to reverse the piston and drive it forward.

As the piston moves in the forward direction, port 347 in the shaft is closed by the piston so that the supplementary rear drive chamber is disconnected from the supply of pressurised flushing fluid, thereby beginning an expansion phase in the supplementary rear drive chamber. Next, the rear end 326' of the piston clears the shoulder 327 on the outer wear sleeve so that the supplementary rear drive chamber is opened once again to allow flushing fluid to flow through the flushing fluid channel 308 between the outer wear sleeve and the piston, so that it exhausts through the bit and into the hole. When the piston 301 reaches the impact or bottom of stroke position, the cycle begins again.

Figure 5:
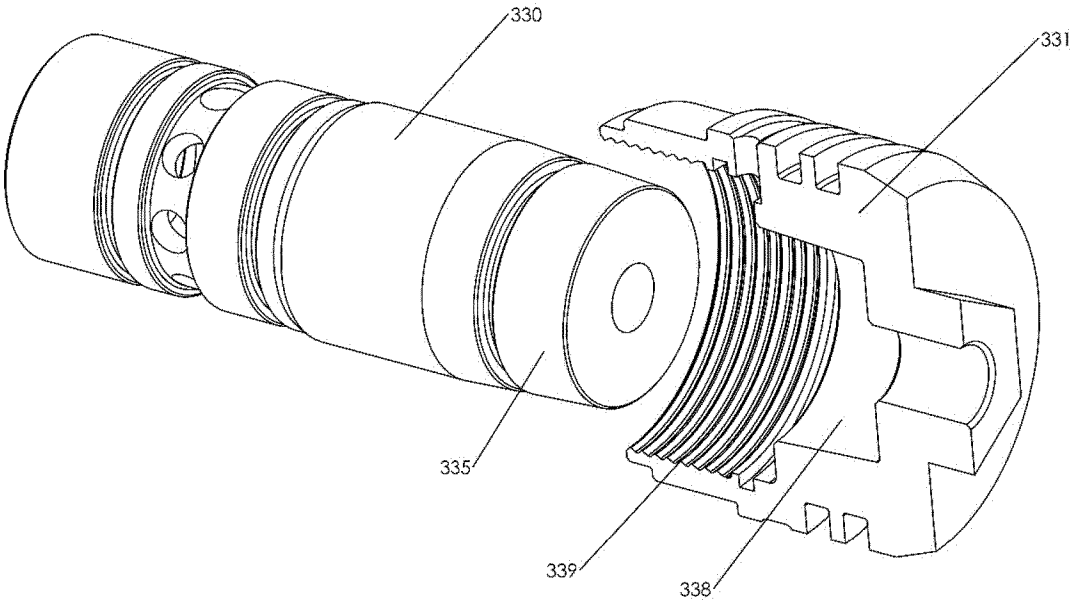
FIG. 5 is an exploded cut-away perspective view of a control valve housing and annular flange, according to an aspect of the present invention.
Figure 6:
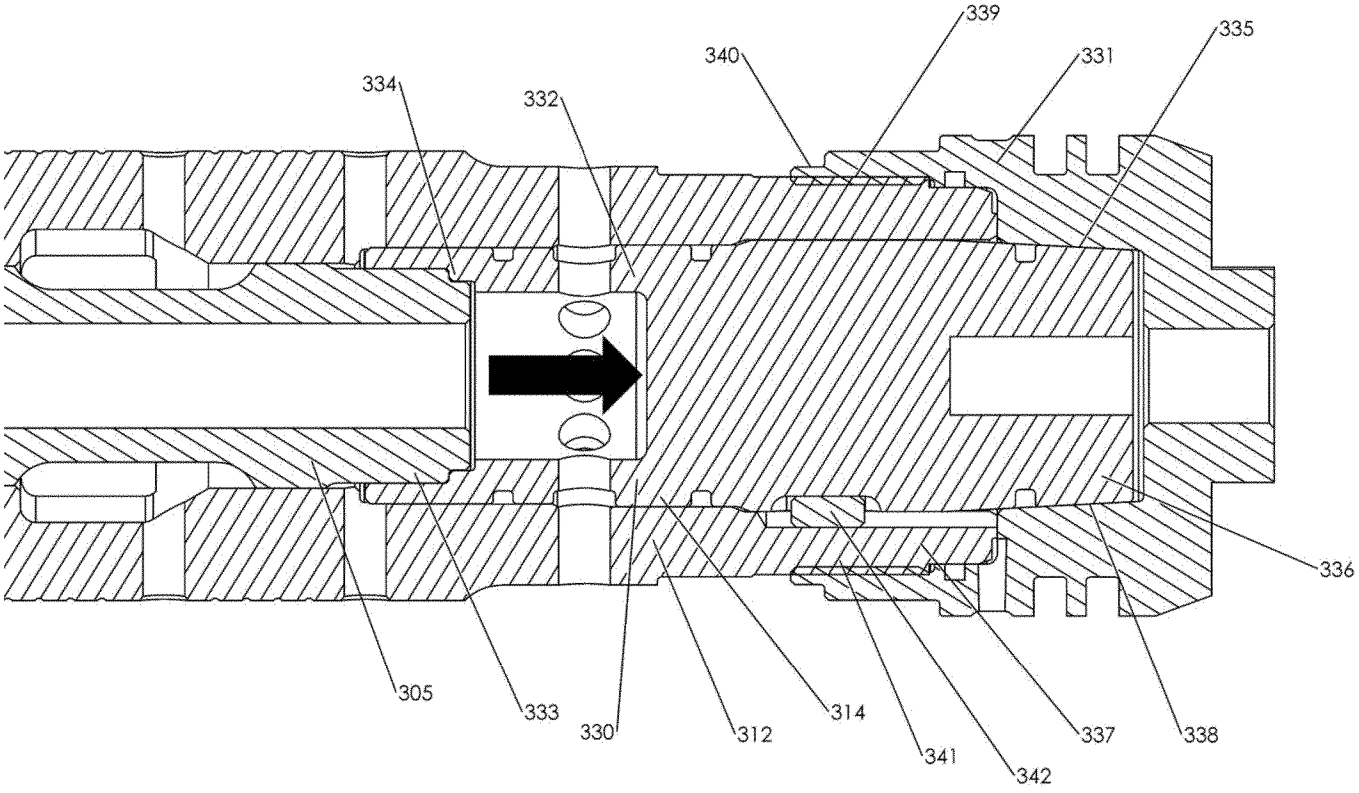
FIG. 6 is a detail view of a portion of the hammer of FIG. 3, showing the control valve housing and annular flange.
Figure 7:
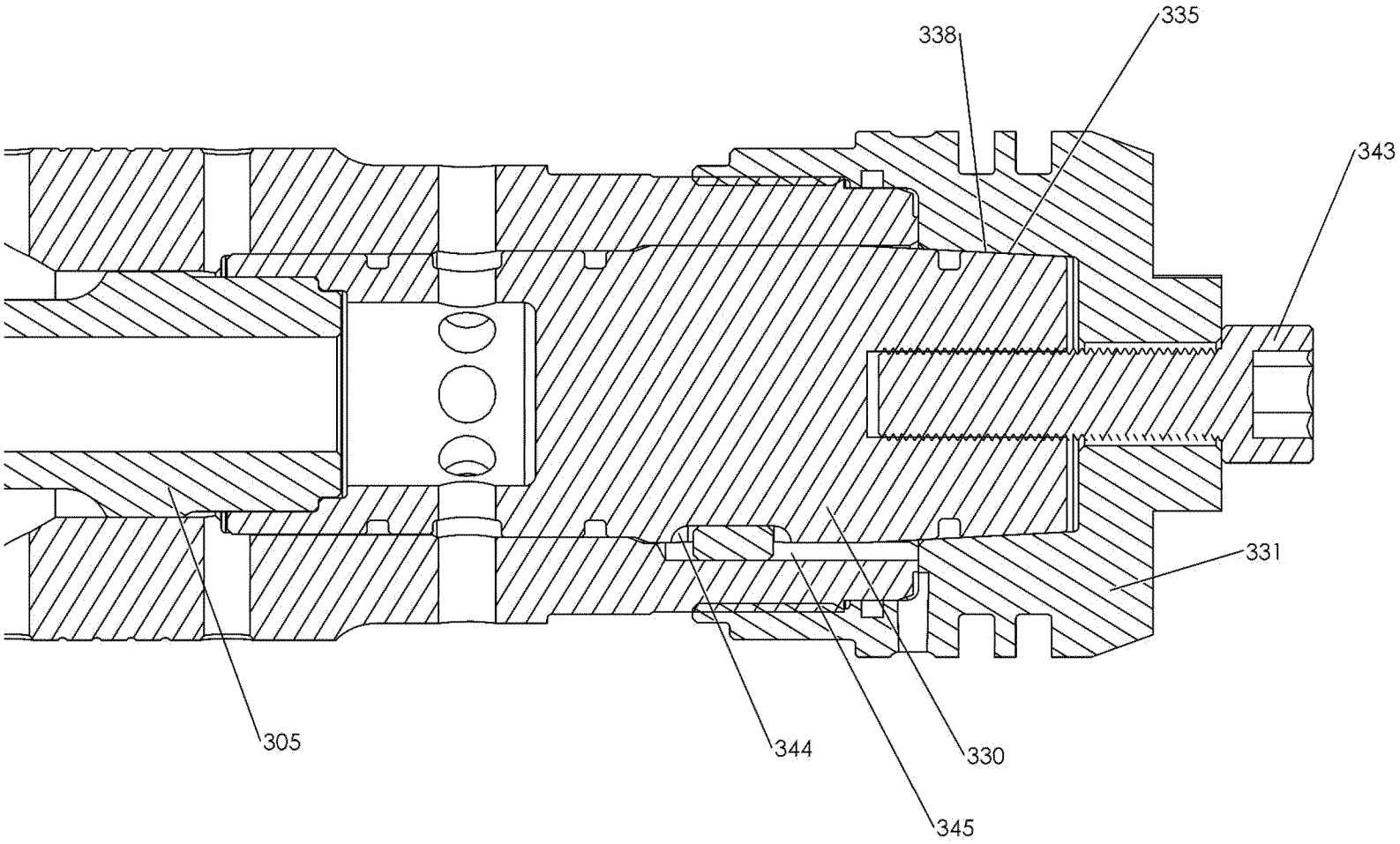
FIG. 7 is a detail view of a portion of the hammer of FIG. 3, showing a pre-locking mechanism.

A second aspect of the invention is also illustrated in FIG. 3, and shown in more detail in FIGS. 5, 6 and 7. Although the two aspects of the invention are illustrated in the context of a single embodiment shown in FIG. 3, each aspect of the invention may also be provided separately. That is, the supplementary rear drive chamber may be provided in certain embodiments, whereas the control valve housing and annular flange may be provided in other embodiments. In particular, the control valve housing and annular flange may be advantageously deployed in open-loop hammers which may or may not comprise an outer wear sleeve.

The hammer 300 further comprises a control valve housing 330 and an annular flange 331. As shown in FIGS. 3 and 6, a rear portion 332 of the control valve housing is disposed within the central bore 314 of the shaft 312. A forward end of the control valve 305 is received within the control valve housing 330. During operation of the hammer, an outwardly-directed shoulder 333 on the control valve may engage with an inwardly-directed shoulder 334 formed internally of the control valve housing. The control valve housing is provided with a tapered outer surface 335 at a forward portion 336 thereof. The tapered outer surface 335 is provided at a portion 336 of the control valve housing forward of a forward end 337 of the shaft. As shown in FIG. 5, the tapered outer surface portion of the control valve housing is substantially frustro-conical in shape. In the embodiment shown, a taper angle of the tapered outer surface 335 is about 1.5 degrees. In other embodiments, taper angles of between 1 degree and 5 degrees may be provided.

The annular flange or bushing 331 has a tapered inner surface 338, which corresponds in shape to and is engageable with the tapered outer surface 335 on the control valve housing. A taper angle of the tapered inner surface 338 of the annular flange is substantially the same as the taper angle of the tapered outer surface of the control valve housing. Connection means in the form of an internal screw thread 339 is provided at a rear end 340 of the annular flange, for connecting the flange to the shaft 312. A corresponding screw-thread 341 is provided externally of the shaft at a forward end 337 thereof. In other embodiments, the screw-thread may be provided externally of the annular flange and the corresponding screw-thread may be provided internally of the chuck.

The hammer further comprises a key 342 disposed between an outer surface of the control valve housing 330 and an inner surface of the shaft 312, to prevent unwanted relative rotation between the control valve housing and the shaft. The key is provided at a portion of the control valve housing 330 rearward of the tapered outer surface 335. In order to assemble the hammer, the key is inserted into a slot 344 formed externally of the control valve housing 330. The housing is then slid into the shaft 312 such that the key is received in a groove 345 formed internally of the shaft. The annular flange is then screwed on to the shaft. In other embodiments, one or more splines may be provided on the outer surface of the control valve housing 330 and a corresponding spline or splines may be provided on the inner surface of the shaft 312. Alternatively, the control valve housing 330 may have a shaped outer profile portion, for example, a square, hexagonal or octagonal profile portion. The shaft may have a correspondingly-shaped inner profile section. In these embodiments, the hammer may be assembled by sliding the housing into the shaft and connecting the annular flange to the shaft as described above.

In use, the control valve housing 330, and thus the control valve 305, is retained in the shaft 312 by the annular flange. Together, the tapered outer surface 335 of the control valve housing and the tapered inner surface 338 of the annular flange form a taper lock which, together with the key 342, prevents the annular flange from becoming disconnected from the shaft during operation of the hammer.

When the hammer is initially assembled, the control valve housing 330 is mounted in the shaft such that there is a small axial clearance between a forward end of the valve housing and an internal surface of the annular flange. That is, the control valve housing is moveable forward in an axial direction. For example, the hammer may be designed such that the allowable axial movement is of the order of 1 mm.

During operation of the hammer, the tapered outer surface 335 is urged or forced forward into engagement with the tapered inner surface 338 by a flow of pressure fluid through the control valve, as shown by the arrow in FIG. 6. The control valve housing is firmly seated within the taper lock by the constant supply of high pressure working fluid to the hammer. The control valve housing is restrained from further forward movement by the annular flange. The annular flange 331 thus retains the valve housing in position in the hammer and engagement between the tapered outer surface 335 and the tapered inner surface 338 prevents the annular flange from becoming unscrewed or disconnected from the shaft during operation of the hammer.

In certain embodiments, the hammer 300 further comprises a removable locking bolt 343 arranged to pre-lock the tapered outer surface into engagement with the tapered inner surface, as shown in FIG. 7. The bolt or fastener may be inserted into a forward end of the annular flange and the control valve housing. When the fastener is engaged with the annular flange 331 and the control valve housing 330, the valve housing moves forward, due to the axial clearance between the valve housing and the annular flange, to pre-lock the tapered outer surface 335 into engagement with the tapered inner surface 338. The bolt 343 may be removed prior to operation of the hammer. Engagement by way of a friction fit between the tapered outer surface 335 and the tapered inner surface 338 ensures that the annular flange remains connected to the shaft, without becoming unscrewed during operation of the hammer, once the bolt is removed.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A closed-loop hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore;

a control valve to control reciprocation of the piston, wherein the control valve is arranged within the central bore of the piston; and an outer wear sleeve, wherein the piston is housed within the outer wear sleeve, and wherein a supplementary rear drive chamber is disposed internally of the outer wear sleeve.

2. A closed-loop hydraulic down-the-hole hammer as claimed in claim 1, wherein the supplementary rear drive chamber is at least partially disposed between the shaft and the outer wear sleeve.

3. A closed-loop hydraulic down-the-hole hammer as claimed in claim 1, wherein the supplementary rear drive chamber is at least partially disposed between the piston and the outer wear sleeve.

4. A closed-loop hydraulic down-the-hole hammer as claimed in claim 1, wherein the supplementary rear drive chamber is arranged to receive a separate flow of fluid to that supplied to the forward and rear drive chambers.

5. A closed-loop hydraulic down-the-hole hammer as claimed in claim 1, wherein the supplementary rear drive chamber is arranged to receive flushing fluid.

6. A closed-loop hydraulic down-the-hole hammer as claimed in claim 1, wherein as the piston moves in a rearward direction, an outer surface of the piston moves into engagement with an inner surface of the outer wear sleeve to close the supplementary rear drive chamber, and the supplementary drive chamber is connected to a supply of pressurised flushing fluid.

7. A closed-loop hydraulic down-the-hole hammer as claimed in claim 6, wherein the supplementary rear drive chamber is closed by engagement between the outer surface of the piston and an inwardly directed shoulder formed internally of the outer wear sleeve.

8. A closed-loop hydraulic down-the-hole hammer as claimed in claim 7, wherein the supplementary rear drive chamber is closed by engagement between an outwardly directed shoulder formed externally of the piston and the inwardly directed shoulder formed internally of the outer wear sleeve.

9. A closed-loop hydraulic down-the-hole hammer as claimed in claim 7, wherein the supplementary rear drive chamber is closed by engagement between a rear end of the piston and the inwardly directed shoulder formed internally of the outer wear sleeve.

10. A closed-loop hydraulic down-the-hole hammer as claimed in claim 6, wherein as the piston moves in a forward direction, the outer surface of the piston moves out of engagement with the inner surface of the outer wear sleeve to open the supplementary rear drive chamber, to provide a flushing fluid channel between the piston and the outer wear sleeve, to allow flushing fluid to flow therebetween.

11. A hydraulic down-the-hole hammer comprising:

an elongate shaft having a central bore;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore;

a control valve to control reciprocation of the piston;

a control valve housing, disposed at least partially within the central bore of the shaft at a forward end of the shaft and arranged to receive the control valve, the control valve housing having a tapered outer surface at a forward portion thereof;

an annular flange connected to the shaft and having a tapered inner surface, corresponding in shape to and engageable with the tapered outer surface of the control valve housing, whereby the control valve housing is retained in the shaft by the annular flange; and engagement means on the control valve housing slidably engageable with complementary engagement means on the shaft to prevent relative rotation therebetween.

12. A hydraulic down-the-hole hammer as claimed in claim 11, wherein the tapered outer surface is arranged to be urged into engagement with the tapered inner surface by a flow of pressure fluid through the control valve.

13. A hydraulic down-the-hole hammer as claimed in claim 11, wherein the tapered outer surface is provided at a portion of the control valve housing forward of a forward end of the shaft.

14. A hydraulic down-the-hole hammer as claimed in claim 11, comprising connection means on the annular flange adapted for connecting the flange to the shaft.

15. A hydraulic down-the-hole hammer as claimed in claim 14, wherein the connection means on the annular flange comprises a screw-thread provided at a rear end thereof, and wherein a corresponding screw-thread is provided on the shaft at a forward end thereof.

16. A hydraulic down-the-hole hammer as claimed in claim 11, wherein the engagement means comprises a key disposed on an outer surface of the control valve housing and the complementary engagement means comprises a groove provided on the inner surface of the shaft.

17. A hydraulic down-the-hole hammer as claimed in claim 11, wherein the engagement means is provided at a portion of the control valve housing rearward of the tapered outer surface.

18. A hydraulic down-the-hole hammer as claimed in claim 11, wherein a taper angle of the tapered outer surface portion is between about 1 degree and about 5 degrees.

19. A hydraulic down-the-hole hammer as claimed in claim 11, further comprising a removable locking fastener arranged to pre-lock the tapered outer surface into engagement with the tapered inner surface, prior to operation of the hammer.

* * * * *